US006675413B2

(12) United States Patent
Hsia

(10) Patent No.: US 6,675,413 B2
(45) Date of Patent: Jan. 13, 2004

(54) LIGHTWEIGHT BOTTOM WALL STRUCTURE FOR PLAYYARD, PEN, AND COT

(76) Inventor: Ben M. Hsia, 19401 Business Center Dr., Northridge, CA (US) 91324

( * ) Notice: Subject to any disclaimer, the term of this patent is extended or adjusted under 35 U.S.C. 154(b) by 0 days.

(21) Appl. No.: 09/973,555

(22) Filed: Oct. 9, 2001

(65) Prior Publication Data

US 2003/0066129 A1 Apr. 10, 2003

(51) Int. Cl.[7] ..... A47D 13/06
(52) U.S. Cl. ..... 5/98.1; 5/99.1; 5/187
(58) Field of Search ..... 5/98.1, 98.3, 99.1, 5/187, 110, 230

(56) References Cited

U.S. PATENT DOCUMENTS 3,018,493 A * 1/1962 Wittbrodt ..... 5/99.1
3,165,760 A * 1/1965 Abajian ..... 5/97
3,805,367 A * 4/1974 Hasty ..... 29/448
4,635,305 A * 1/1987 Wyss ..... 5/99.1
4,688,281 A * 8/1987 Lantz ..... 5/111
4,985,948 A * 1/1991 Mariol ..... 5/99.1
5,711,040 A * 1/1998 Huang ..... 5/99.1
5,752,283 A * 5/1998 Arens ..... 5/99.1
5,809,592 A * 9/1998 McAllister ..... 5/99.1
5,936,996 A * 8/1999 Eidem et al. ..... 373/85

* cited by examiner

*Primary Examiner*—Michael F. Trettel
(74) *Attorney, Agent, or Firm*—Raymond Y. Chan; David and Raymond Patent Group

(57) ABSTRACT

A lightweight bottom wall structure for playyard, pen, and cot, which includes a boundary frame constructed to support a fabric made boundary shelter, wherein the lightweight bottom wall includes a bottom frame supported at a bottom portion of the boundary frame and defines a central window. A bottom wall includes a first layer having a tension surface and a second layer overlapped with the first layer to define a receiving groove between the first and second layers, wherein the bottom frame has a size and shape adapted to be fittedly received in the receiving groove so as to mount the first layer covering the central window to form the tension surface.

20 Claims, 8 Drawing Sheets

LIGHTWEIGHT BOTTOM WALL STRUCTURE FOR PLAYYARD, PEN, AND COT

BACKGROUND OF THE PRESENT INVENTION

1. Field of Invention

The present invention relates to bottom wall structure, and more particularly to a lightweight bottom wall structure for a play yard, pen, and cot, which has a rigid, simple, and strong structure in lower manufacturing cost to evenly distribute and support a downward force of a user's weight.

2. Description of Related Arts

Play yard, pen, and cot are used to restrict the movement of a baby who is able to trail or walk when the parents cannot keep their eyes on their babies. A conventional play yard, pen, or cot comprises a boundary frame having a receiving cavity and a supporting board disposed in a bottom of the receiving cavity for supporting the user's weight. However, the conventional play yard, pen and cot have several drawbacks.

In order to provide a rigid structure to support the user's weight, the supporting board must be constructed to have a tension-supporting surface. It is worth to mention that tension-supporting surface provides a predetermined tension force evenly distributed on the supporting board, wherein when the downward force of the user's weight is greater than the tension force, the supporting board will be cracked or even broken. However, the supporting board is a rigid wooden board or cardboard that the concentrated downward force may crack the supporting board easily, especially when the user, such as a young child, jumps on the supporting board. Therefore, the rigid supporting board may not be the best solution for the play yard, pen, and cot.

Moreover, the supporting board is bulky and heavy for storage and transportation. For saving space for travel and storage, most of the play yards, pens and cots are made foldable to reduce their storage and packing sizes. However, the supporting board must be taken out from the boundary frame in order to fold up the play yard, pen, or cot, that may loss the ordinary features such as portable and compact size of the play yard, pen, and cot. Even though the supporting board is constructed of a plurality of sections that allows the supporting board to be folded into a compact size and unfolded for use, the fold-up structure of the supporting board cannot provide the high tension-supporting surface. In other words, the foldable supporting board cannot rigidly support the user thereon.

SUMMARY OF THE PRESENT INVENTION

A main object of the present invention is to provide a lightweight bottom wall structure for play yard, pen, and cot, which has a rigid, simple, and strong structure to evenly distribute and support a downward force of a user's weight.

Another object of the present invention is to provide a lightweight bottom wall structure for play yard, pen, and cot, wherein the bottom wall is a durable and flexibility for providing a high tension-supporting surface to enhance the life span of the bottom wall.

Another object of the present invention is to provide a lightweight bottom wall structure for play yard, pen, and cot, which provides a substantial support without altering or complicating the original structure of the play yard, pen, and cot.

Another object of the present invention is to provide a lightweight bottom wall structure for play yard, pen, and cot, which can incorporate with any play yard, pen, and cot having a foldable structure. In other words, the play yard, pen, and cot can be folded with the bottom wall into a compact unit without altering both the bottom wall and the original structure of the play yard, pen, and cot.

Another object of the present invention is to provide a lightweight bottom wall structure for playyard, pen, and cot, wherein no expensive or mechanical structure is required to employ in the present invention in order to achieve the above mentioned objects. Therefore, the present invention successfully provides an economic and efficient solution for providing reinforced supporting configuration to the user.

Accordingly, in order to accomplish the above objects, the present invention provides a play yard, pen, and cot, comprising:

a boundary frame constructed to support a fabric made boundary shelter and comprising a bottom frame defining a central window; and a bottom wall comprising a first layer having a tension surface and a second layer overlapped with the first layer to define a receiving groove between the first and second layers, wherein the bottom frame has a size and shape adapted to be fittedly received in the receiving groove so as to mount the first layer covering the central window to form the tension surface.

DETAILED DESCRIPTION OF THE PREFERRED EMBODIMENT

Figure 1:
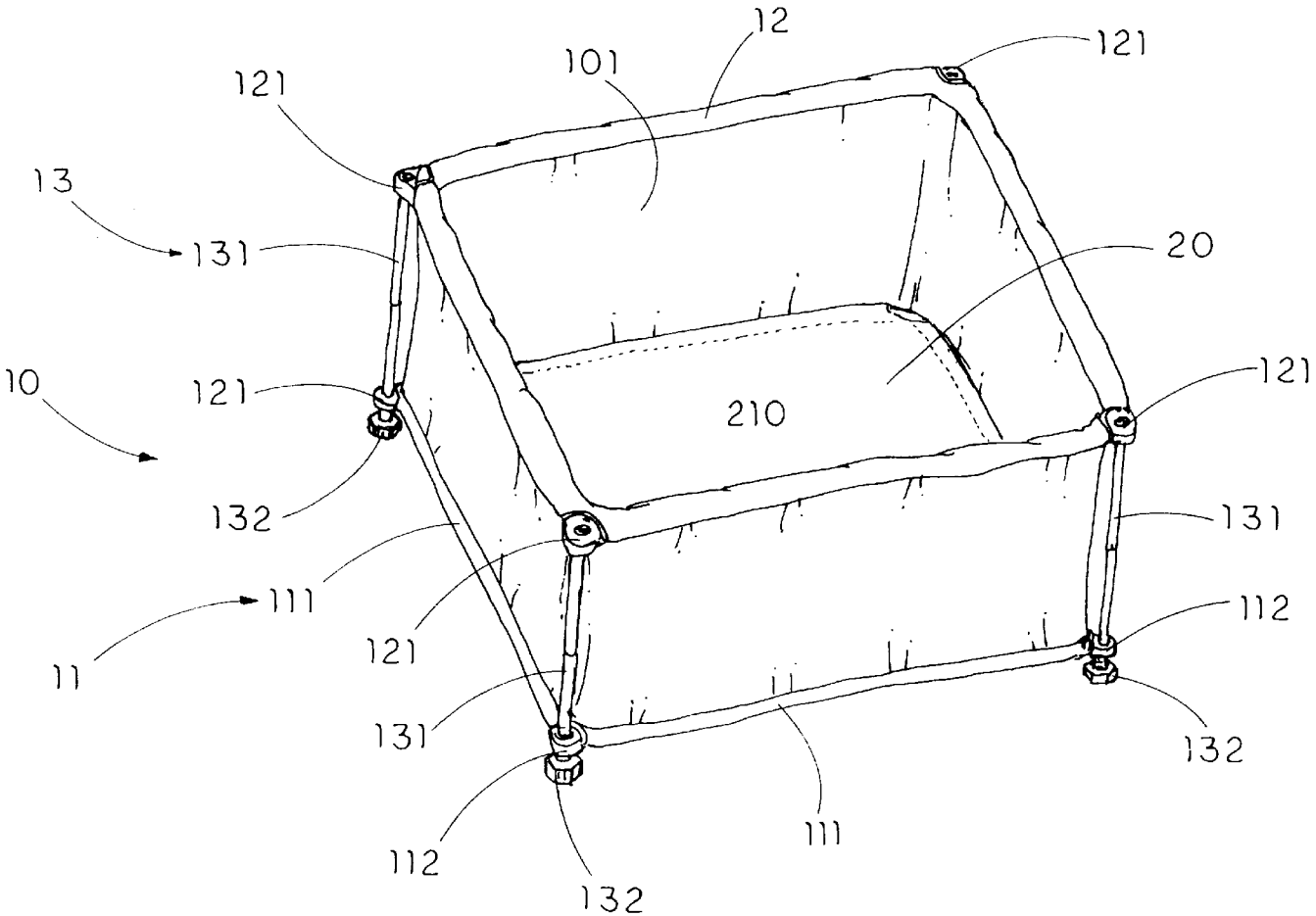
FIG. 1 is a perspective view of a lightweight bottom wall structure for play yard, pen, and cot according to a first preferred embodiment of the present invention.
Figure 2:
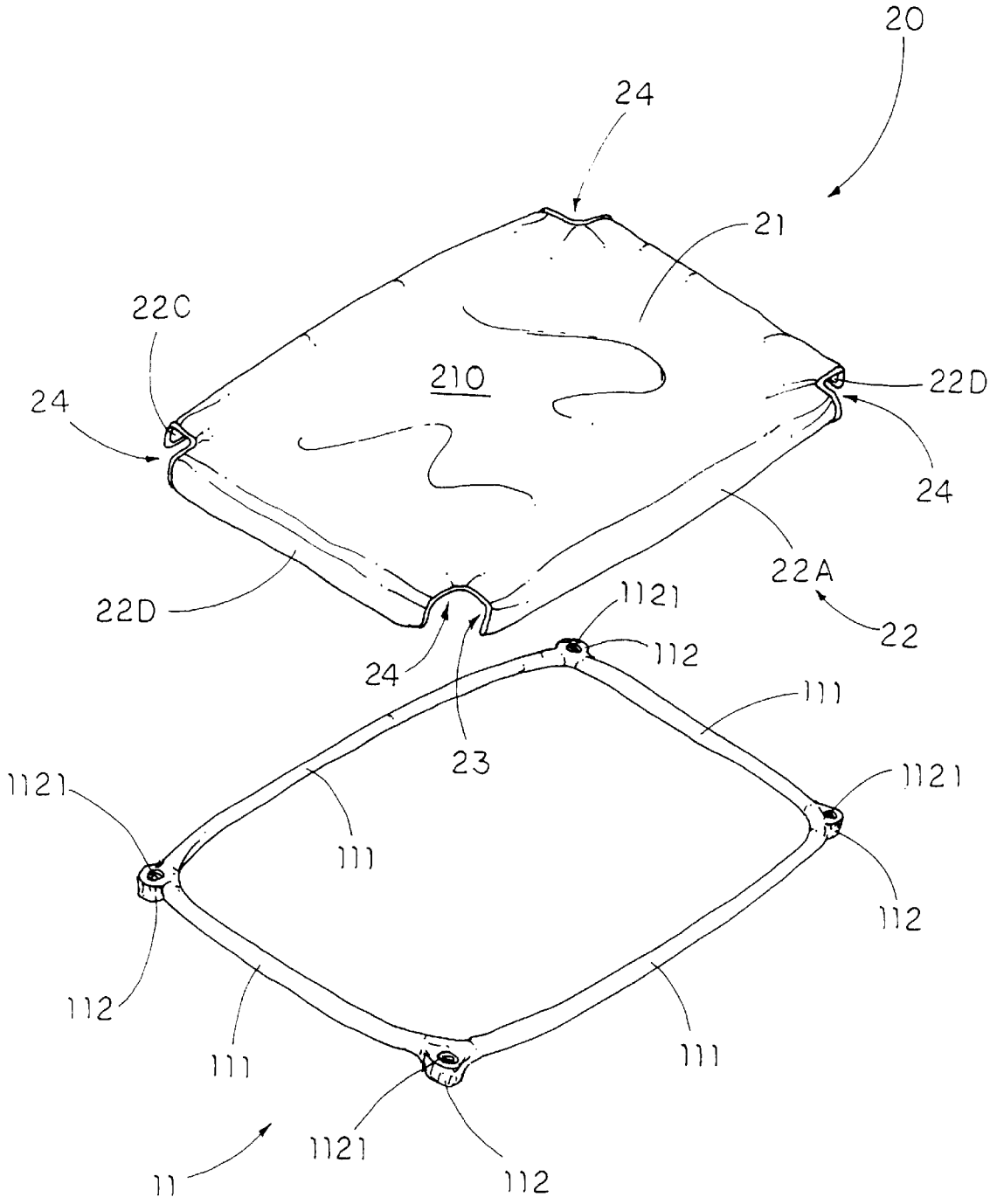
FIG. 2 is an exploded perspective view of the lightweight bottom wall structure for play yard, pen, and cot according to the above first preferred embodiment of the present invention.
Figure 3:
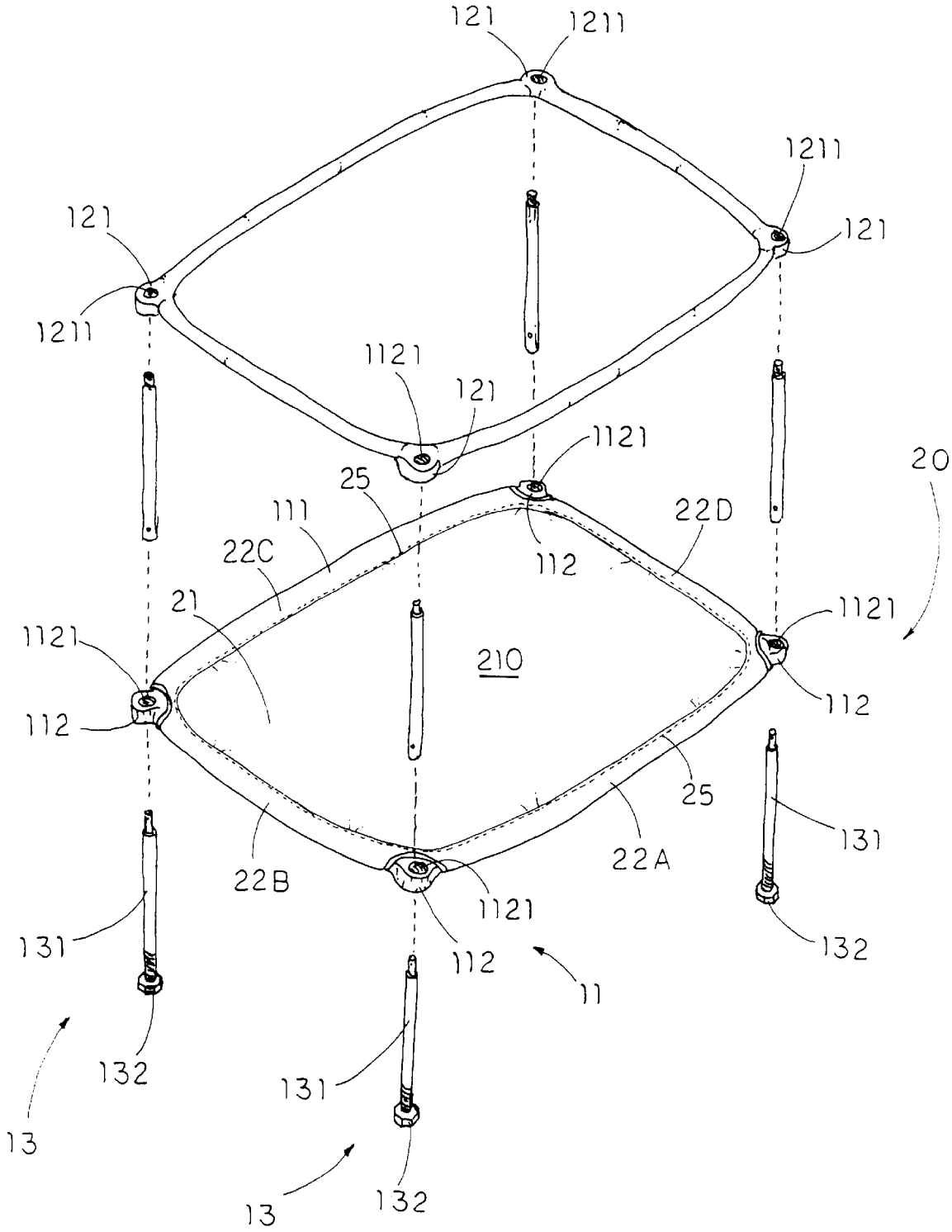
FIG. 3 is an exploded perspective view of the play yard, pen, and cot incorporated with the lightweight bottom wall structure according to the above first preferred embodiment of the present invention.

Referring to FIGS. 1 and 2 of the drawings, a lightweight bottom wall structure for play yard, pen, and cot according to a first preferred embodiment of the present invention is illustrated, wherein the play yard, pen, and cot comprises a boundary frame 10, which is constructed to support a fabric made boundary shelter 101 and comprises a bottom frame 11 defining a central window 110.

The bottom wall 20 comprises a first layer 21 having a tension surface 210 and a second layer 22 overlapped with the first layer 21 to define a receiving groove 23 between the first and second layers 21, 22, wherein the bottom frame 11 has a size and shape adapted to be fittedly received in the receiving groove 23 so as to mount the first layer 21 covering the central window 110 to form the tension surface 210.

According to the preferred embodiment, the boundary frame 10 further comprises a top frame 12 positioned above the bottom frame 11 and a supporting frame 13 connected the top frame 12 with the bottom frame 11.

The bottom frame 11 comprises two pairs of parallel bottom frame legs 111 connected end to end to form a rectangular structure that also supports the bottom wall 20 in a corresponding rectangular shape, and four bottom joints 112 provided at four corners of the bottom frame 11 respectively. Each of the bottom joints 112 has a tubular sleeve 1121 extending vertically.

The top frame 12, having a corresponding rectangular shaped, comprises four top joints 121 provided at four corners of the top frame 12 respectively, wherein each of the top joints 121 has a tubular socket 1211 that opens downwardly and aligns with the tubular sleeve 1121 of the respective bottom joint 112.

The supporting frame 13 comprises four supporting posts 131 each of which has an inserting end and a locking end wherein each of the supporting posts 131 is arranged to slidably pass through the tubular sleeve 1121 of the respective bottom joint 112 until the inserting end of the supporting post is fittedly inserted into the tubular socket 1211 of the top joint 121 and the locking end of the supporting post 131 is lock up with the tubular sleeve 1121 of the bottom joint 112, so as to securely lock up the supporting post 131 between the top and bottom joints 121, 112.

In order to securely lock up the supporting frame 13 between the top frame 12 and the bottom frame 11, the supporting frame 13 further comprises four locking buttons 132 firmly affixed to the locking ends of the supporting posts 131 respectively, wherein each of the locking buttons 132 has an outer thread portion adapted to rotatably screw with an inner thread portion of the tubular sleeve 1121 of the respective bottom joint 112. It is worth to mention that the four locking buttons 132 can function as four foot stands respectively for supporting the boundary frame 10 on ground in a stabilized manner.

As shown in FIG. 2, the first layer 21 and the second layer 22 have the same rectangular size and overlappedly connected side to side to define the receiving groove 23 between, the first layer 21 and the second layer 22, wherein the receiving groove 23 has an opening 231 that opens inwardly. The second layer 22 has four edge sections 22A, 22B, 22C, 22D firmly connected end to end by stitching, wherein the receiving groove 23, having a U-shaped cross section, is defined between each edge section 22A~D of the second layer 22 and the first layer 21 and adapted for fittedly receiving the bottom frame 11 via the opening 231.

In order to form the receiving groove 23 of the bottom wall 20, the four edge sections 22A~D of the second layer 22 are respectively formed by folding four outer edges of the first layer 21 to a bottom surface thereof overlappedly. In other words, the bottom wall 20 can be formed by a piece of sheet folded at four outer edges to form the first and second layers 21, 22 such that the bottom wall 20 has the corresponding shape and the second layer 22 is integrally extended from the first layer 21 overlappedly. Alternatively, the four edge sections 22A~D of the second layer 22 can be four independent pieces that four outer circumferential edges of the edge sections 22A~D of the second layer 22 are firmly connected to four outer circumferential edges of the first layer 21 by sewing respectively (for example).

Accordingly, the bottom wall 20 is preferred to be made of lightweight and durable fabric material, such as mesh fabric or nylon, which is capable of evenly supporting a downward force of a user's weight exerted on the bottom wall 20. The sheet material for making the web of a trampoline is also suitable for making the bottom wall 20. Other elastic and durable sheet materials are fine too. The bottom wall 20 incorporated with the play yard, pen, and cot is specifically designed for a young child who has a weight up to 100 lbs. Of course, the more durable material is used to make the bottom wall 20, the play yard, pen, and cot of the present invention can support more weight that evenly distributes throughout the tension surface 210 of the bottom wall 20.

The bottom wall 20 further has four corner notches 24 provided at four corners of the bottom wall 20 for registering with the four bottom joints 112 respectively.

To enhance the tension of the bottom wall 20 within the tension surface 210, the bottom wall 20 further comprises at least a retaining element 25 extended along the receiving groove 23 for retaining the bottom frame 11 therein. According to the preferred embodiment, the retaining element 25 is a stitching line extended at four sides of the bottom wall 20 by sewed through the first and second layers 21, 22, wherein a surrounding tubular chamber is formed between the stitching line of the retaining element 25 and the four sides of the bottom wall 20 to form the receiving groove 23, so that the four bottom frame legs 111 of the bottom frame 11 are enclosed and retained inside the surrounding tubular chamber of the receiving groove 23. In other words, the bottom frame 11 is received in the receiving groove 23 and the retaining element 25 is stitched along the receiving groove 23 to enclose the bottom frame legs 111 of the bottom frame 11 therein.

Figure 4:
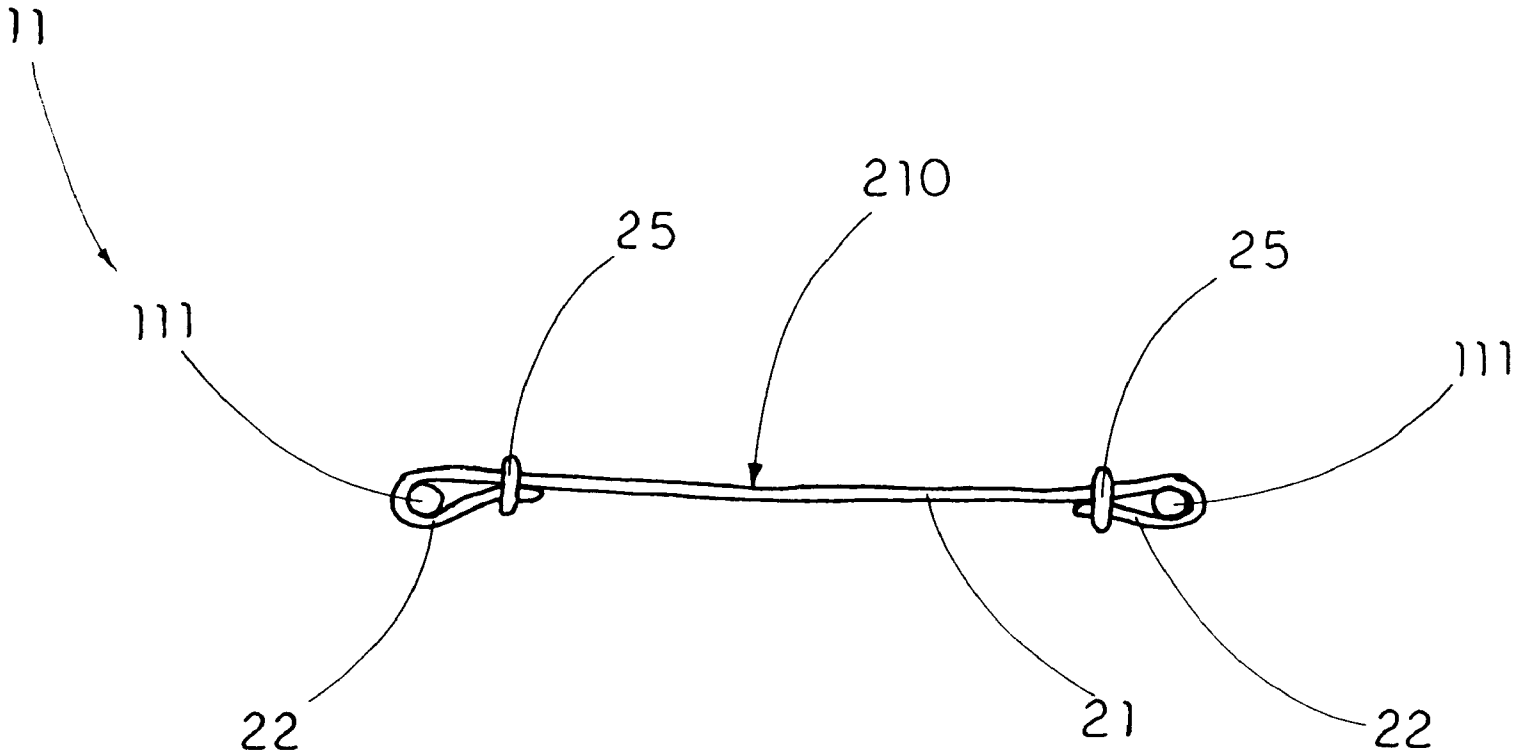
FIG. 4 is a sectional view of the lightweight bottom wall structure for play yard, pen, and cot according to the above first preferred embodiment of the present invention.

As shown in FIG. 4, when the retaining element 25 is provided on the receiving groove 23 of the bottom wall 20, the tension surface 210 of the bottom wall 20 will be stretched aside in order to increase the tension of the bottom wall 20 within the tension surface 210 thereof. Moreover, the retaining element 25 can also retain the bottom wall 20 on the bottom frame 11 in position. Thus, the retaining element 25, i.e. the surrounding stitching line, substantially retains a predetermined tension on the tension surface 210 of the bottom wall 20. It is because the size of the bottom wall 20 should be made to fittedly receive the bottom frame 11 therein. After the bottom wall 20 is mounted on the bottom frame 11, there is still a space defined between the first and second layers 21, 22, wherein the thickness of such space is equal to the thickness of the bottom frame 11. Then, on the bottom wall 20, the manufacturer can sew the stitching line of the retaining element 25 along the inner side of the four bottom frame legs 111 of the boundary frame 11. As shown in FIG. 4, the stitching line of the retaining element 25 substantially sews the first and second layers 21, 22 together that the inner surface of the first second 21 are pulled to contact with the inner surface of the second layer 22. In order words, the first and second layers 21, 22 are pushed towards each other so as to substantially increase the surface tension of the first and second layers 21, 22. The surface area of the first layer 21 encircled by the stitching line of the retaining element 25 forms the tension surface 210.

Accordingly, the boundary frame 10 can be folded up into a compact size by rotatably unscrewing the locking stands 132 from the bottom joints 112 respectively for unlocking the supporting posts 131 with the bottom joints 112 so as to slidably detach the four supporting posts 131 from the top frame 12 and the bottom frame 11. Then, the boundary frame 10 can be folded by minimizing a distance between the top frame 12 and the bottom frame 11. A cushion pad or a mattress is preferred to place on the bottom wall 20 to provide a soft feeling for the user to play thereon.

Figure 5:
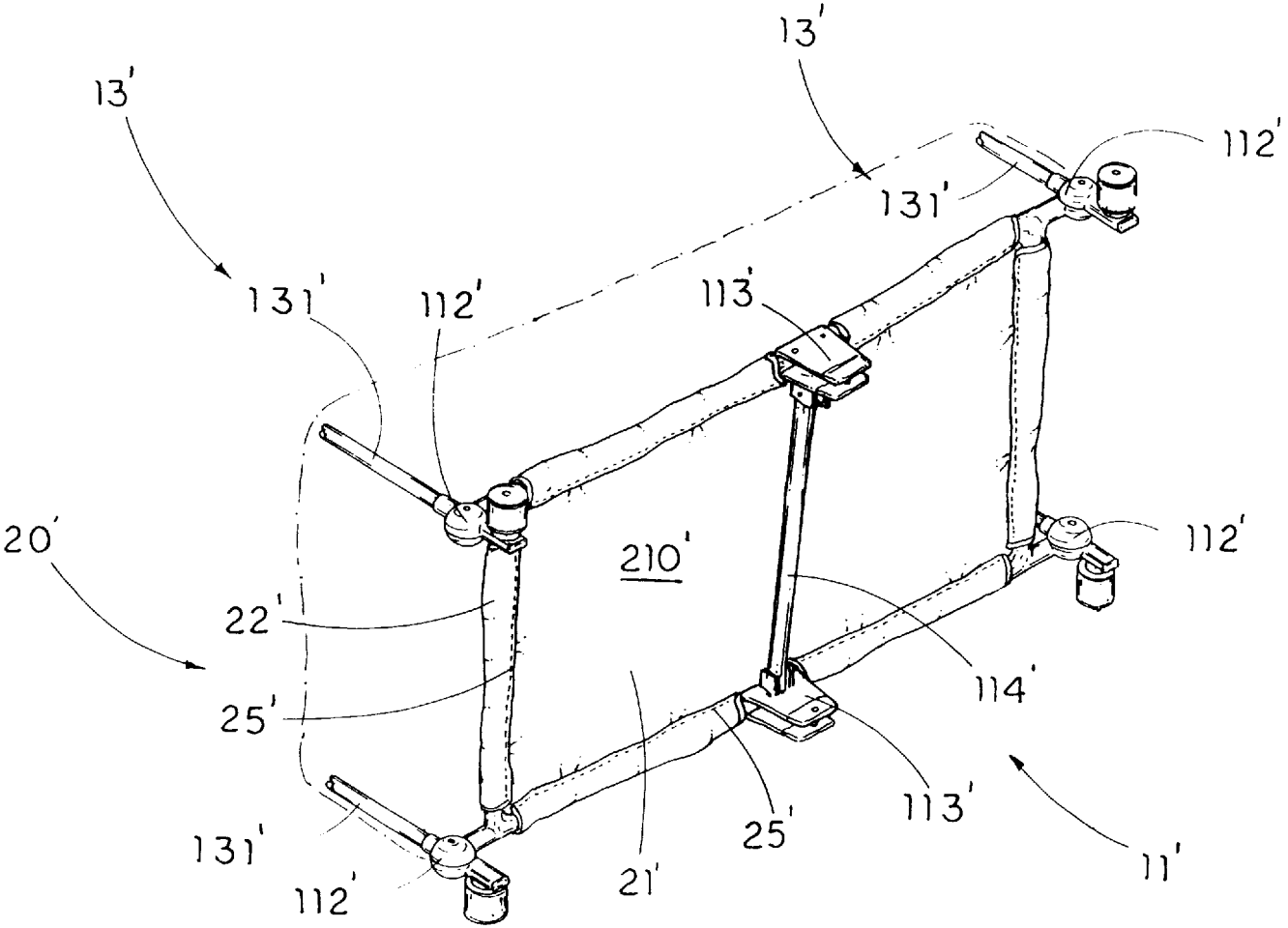
FIG. 5 is a perspective view of a lightweight bottom wall structure for play yard, pen, and cot according to a second preferred embodiment of the present invention.

Referring to FIG. 5, a second embodiment of the boundary frame 10' is illustrated, which is an alternative mode of the first embodiment of the present invention. The first alternative mode to be illustrated is that the boundary frame 10' can be folded up to half reduce its size to save space during storage and transportation. In other words, the first alternative mode mainly illustrates that the bottom wall 20' can be incorporated with the collapsible boundary frame 10'. It is worth to mention that the bottom wall 20' has the same structure of the first embodiment to mount on the bottom frame 11' of the boundary frame 10'.

Referring to FIG. 5, the bottom frame 11' comprises two pairs of parallel bottom frame legs 111', which is the first pair and second pair of bottom frame legs 111', connected end to end to form a rectangular structure that also supports the bottom wall 20' in a corresponding rectangular shape, and four bottom joints 112' provided at four corners of the bottom frame 11' respectively. The first pair of the bottom frame legs 11' is a pair of foldable frame legs wherein a folding joint 113' is constructed at a center portion of each of the first pair of bottom frame legs 111' such that the bottom frame 11' has a foldable structure that enables the bottom frame 11' to be folded up to half reduce its size. Since the bottom wall 20' has a flexible ability, the bottom wall 20' can be folded into half while folding up the bottom frame 11'. The bottom frame 11' further comprises a brace support 114' firmly connected between the two folding joints 113' so as to substantially support the bottom wall 20' thereon.

The top frame 12' comprises a first pair of parallel top frame arms 122' and a second pair, of parallel top frame arms 123', wherein the four top joints 121' are arranged to connected the four top frame arms 122', 123' together end to end to form a corresponding rectangular structure. Accordingly, two adjacent top joints 121' have two transverse tubular sleeves 121*a* respectively and another two adjacent top joints 121' have two tubular sockets 121*b* that open transversely and align with the tubular sleeves 121*a* of the top joints 121' respectively.

Each of the first pair of the top frame arms 122' has an inserting end and a locking end wherein each of the first pair of the top frame arms 122' is arranged to slidably passing through the tubular sleeve 121*a* of the respective top joint 121' until the inserting end of the top frame arms 122' is fittedly inserted into the tubular socket 121*b* of the opposed top joint 121' and the locking end of the top frame arms 122' is lock up with the tubular sleeve 121*a* of the respective top joint 121', so as to securely lock up the top frame arms 122' between the two top joints 121'. In other words, when the first pair of the top frame arms 122' are detached from the top joints 121', the bottom frame 11' is adapted to be folded in half.

Figure 6:
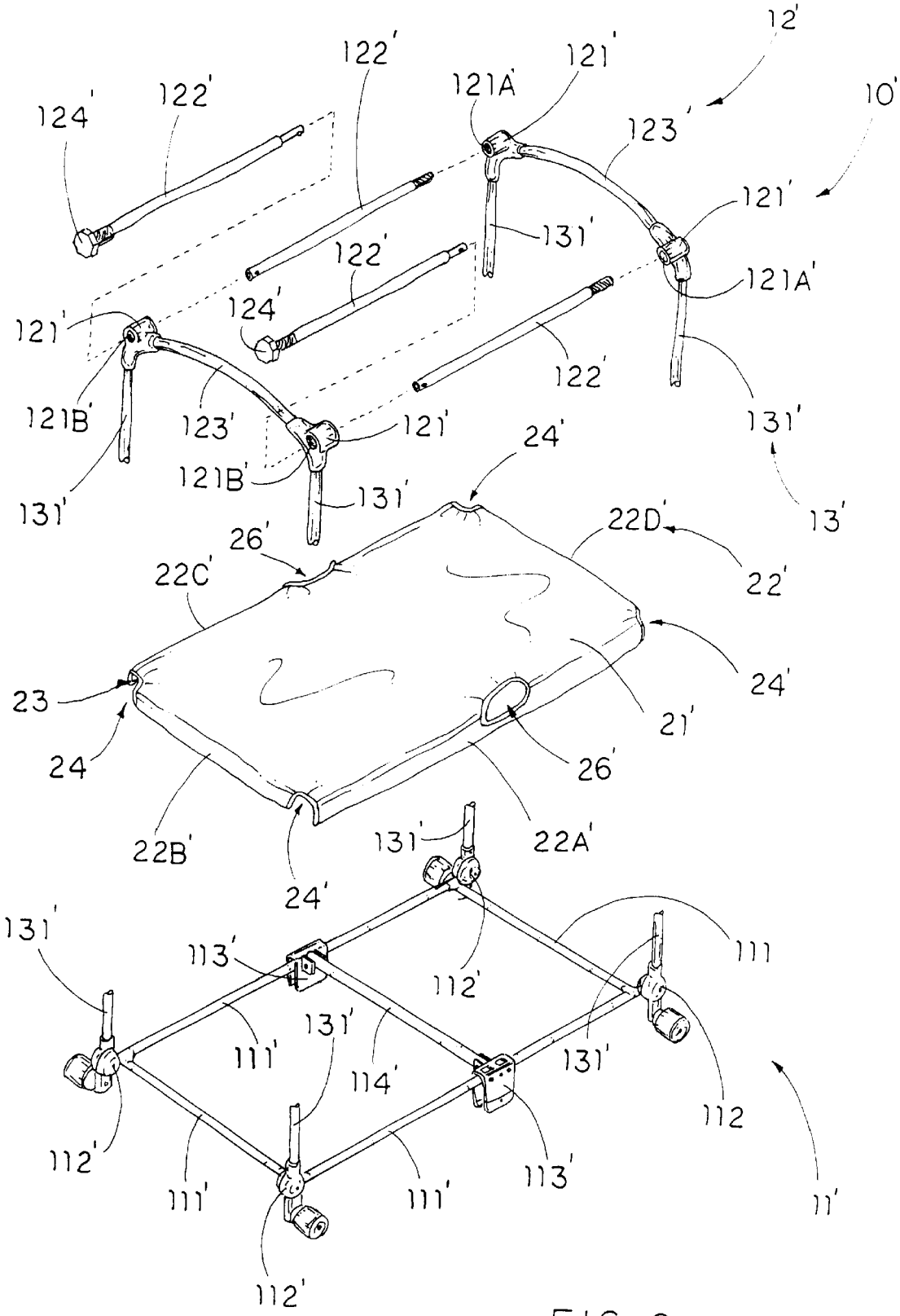
FIG. 6 is an, exploded perspective view of the play yard, pen, and cot incorporated with a lightweight bottom wall structure according to the above second preferred embodiment of the present invention.

Accordingly, each of the first pair of the top frame arms 122' is constructed to form two detachable portions thereof so as to reduce a length of each of the first pair of the top frame arms 122' in half for save space during storage and transportation, as shown in FIG. 6.

The top frame 12' further comprises two locking buttons 124' firmly affixed to the locking ends of the first pair of the top frame arms 122' respectively, wherein each of the locking buttons 124' has an outer thread portion adapted to rotatably screw with an inner thread portion of the tubular sleeve 121*a* of the respective top joint 121'.

The supporting frame 13' comprises four supporting posts 131' arranged to firmly connect between the four top joints 121' and the four bottom joints 112' respectively.

The bottom Wall 20' comprises a first layer 21' and a second layer 22" having four edge sections 22A'~D' to define the receiving groove 23' between the first layer 21' and the edge sections 22A'~D', wherein the four edge sections 22A'~D' of the second layer 22' are respectively formed by folding four outer edges of the first layer 21' to a bottom surface thereof overlappedly.

The bottom wall 20' further has four corner notches 24' provided at four corners of the bottom wall 20' for registering with the four bottom joints 112' respectively and two side notches 26' provided at two opposed sides of the bottom wall 20' for registering with the two folding joints 113' of the bottom frame 11' respectively.

The retaining element 25' which is a stitching line is provided along the bottom wall 20' for enclosing the bottom frame legs 111' in the receiving groove 23' so as to substantially retain a predetermined tension on the tension surface 210' of the bottom wall 20'.

Figure 7:
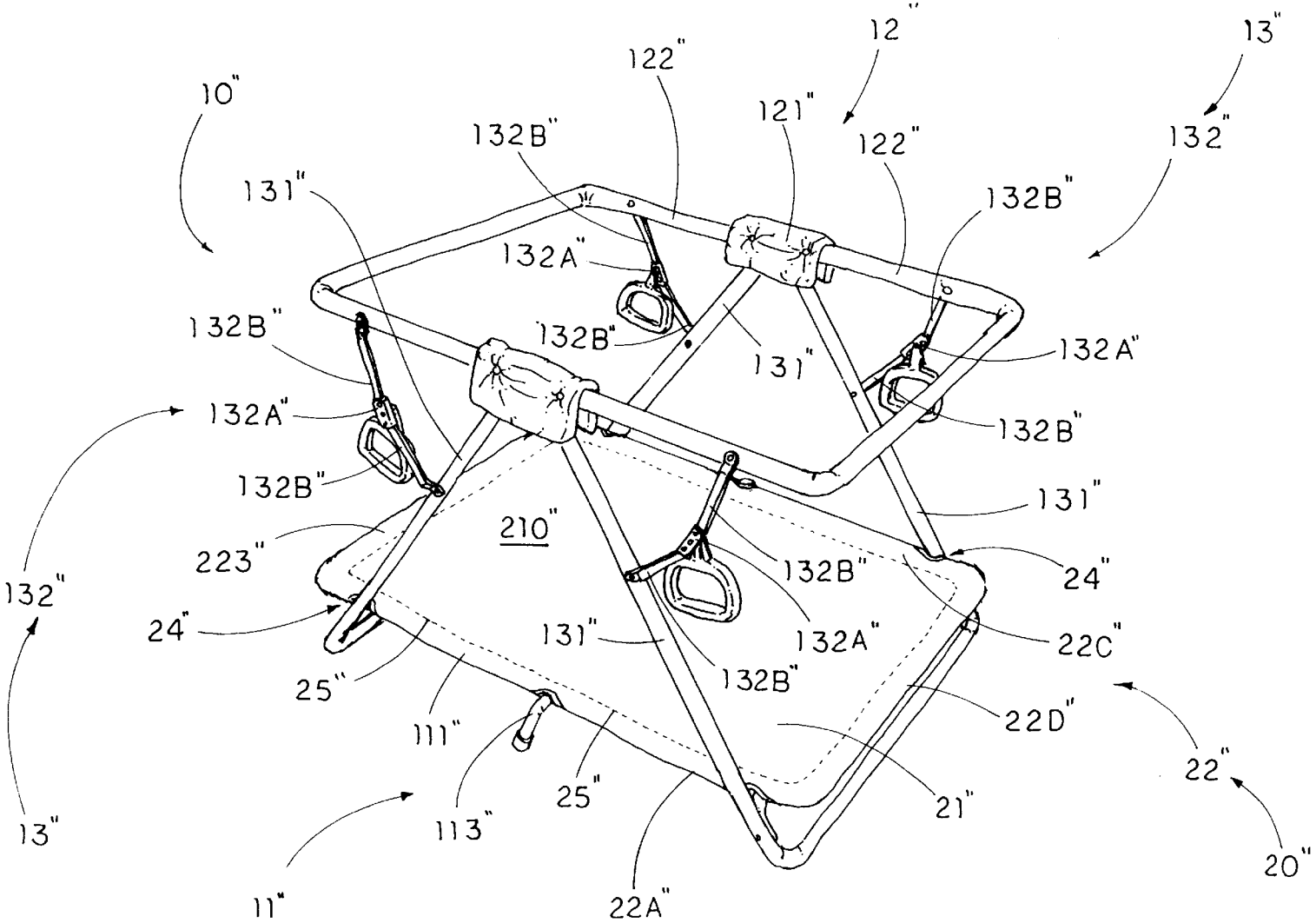
FIG. 7 is a perspective view of a lightweight bottom wall structure for play yard, pen, and cot according to a third preferred embodiment of the present invention.

FIG. 7 illustrates a second alternative mode of the present invention which illustrates the bottom wall 20" can be incorporated with the boundary frame 10" having different foldable structure.

The bottom frame 11" comprises two U-shaped bottom frame legs 111" pivotally connected end to end to form a rectangular structure that also supports the bottom wall 20" in a corresponding rectangular. The bottom frame 11" further comprises a U-shaped leg support 113" transversely connected to a mid-portion of the bottom frame 11" in a pivotally movable manner. The leg support 113" has two downwardly support ends that function as two foot stands respectively for supporting the boundary frame 10" on the ground in a stabilizer manner.

The top frame 12" having corresponding rectangular shaped comprises two top joints 121". and two U-shaped top frames arms 122" each having two ends pivotally connected to the two top joints 121" respectively.

Figure 8:
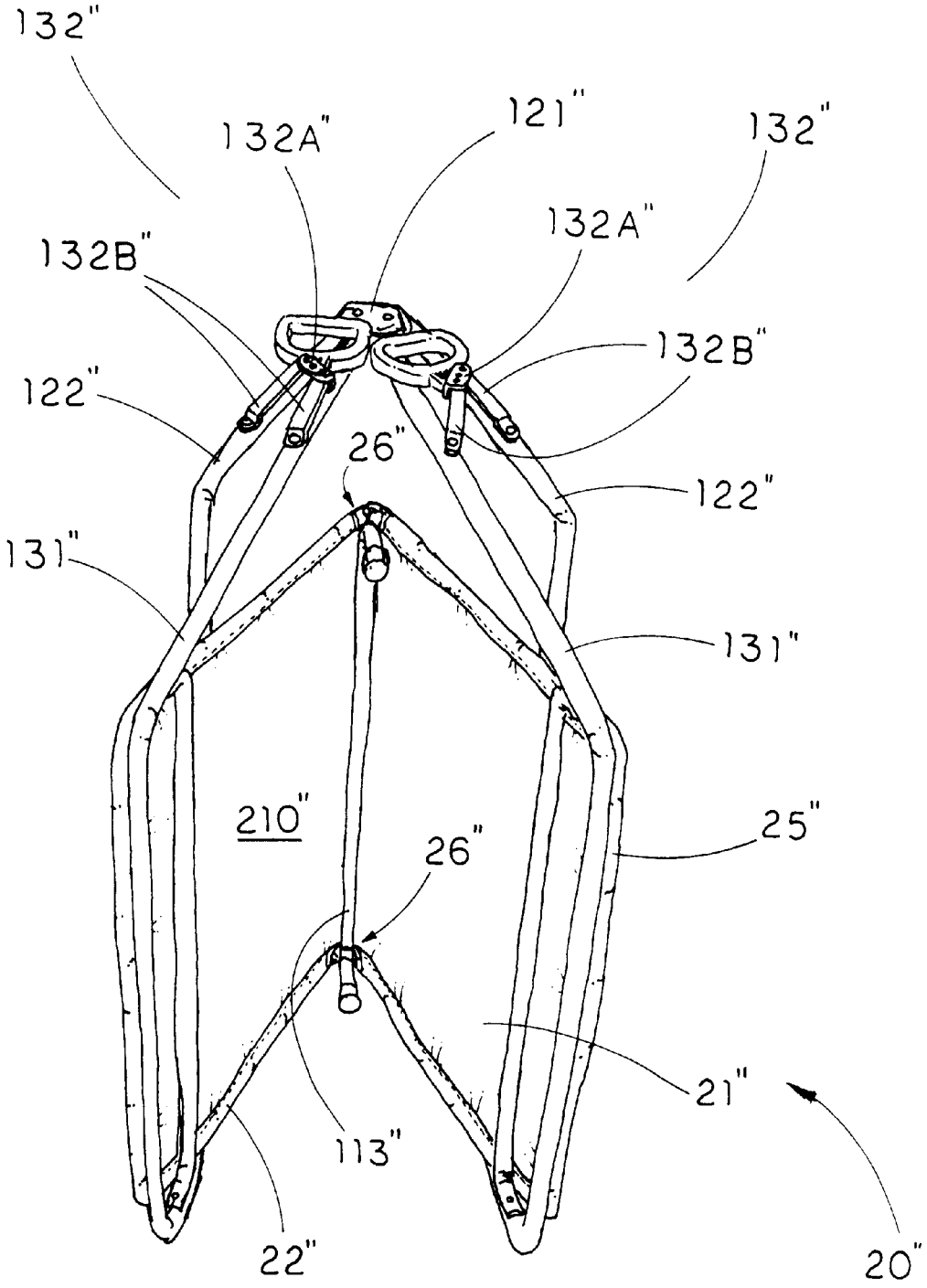
FIG. 8 is a perspective view of the structure for play yard, pen, and cot incorporated with a lightweight bottom wall structure in a folded state according to the above third preferred embodiment of the present invention.

The supporting frame 13" comprises two U-shaped supporting posts 131" each of which has two ends pivotally connected to the two top joints 121" respectively and inclinedly and downwardly extended to pivotally connected to outer sides of the two bottom frame legs 111" respectively. The supporting frame 13" further comprises two pairs of locking joints 132" for locking the top frame arms 122" in a horizontal position to form a rectangular structure. Each of the locking joints 132" comprises a lock body 132*a*" and two pivot arms 132*b*" having two inner ends pivotally connected to the lock body 132*a*" respectively and two outer ends pivotally connected to the top frame arm 122" and the supporting post 131" respectively, in such a manner that the two pivot arms 132*b*" are arranged to pivotally fold in an opposite direction to support the respective top frame arm 122" in a horizontal position and pivotally fold towards each other to pivotally drop down the top frame arm 122" towards to the supporting post 131", as shown in FIG. 8.

The bottom wall 20" comprises a first layer 21" and a second layer 22" having four edge sections 22A"~D" to define the receiving groove 23" between the first layer 21" and the edge sections 22A"~D" wherein the four edge sections 22A"~D" of the second layer 22" are respectively formed by folding four outer edges of the first layer 21" to a bottom surface thereof overlappedly.

The bottom wall 20" further has four comer notches 24" provided at four corners of the bottom wall 20" for registering with the supporting posts 131" respectively and two side notches 26" provided at two opposed sides of the bottom wall 20" for registering with the two outer sides of the leg support 113" of the bottom frame 11" respectively.

The retaining element 25" which is a stitching line is provided along the bottom wall 20" for enclosing the bottom frame legs 111" in the receiving groove 23" so as to substantially retain a predetermined tension on the tension surface 210" of the bottom wall 20".

As shown in FIG. 8, the two top frame arms 122" are adapted to drop down to the supporting posts 131" respectively to fold up the top frame 12" in half. Besides, the bottom frame has a foldable structure that enables the bottom frame 11" to be folded up to half by pivotally folding the two bottom frame legs 111" together. Therefore, the boundary frame 10" is capable of folding up to half to reduce its size. Since the bottom wall 20" has a flexible ability, the bottom wall 20" can be folded into half while folding up the bottom frame 11".

What is claimed is:

1. A boundary structure, comprising:

a boundary frame constructed to support a fabric made boundary shelter;

a bottom frame which is supported at a bottom portion of said boundary frames and defines a central window, and a bottom wall comprising a first layer having a tension surface and a second layer overlapped with said first layer to define a receiving groove between said first and second layers, wherein said bottom frame has a size and shape arranged to be fittedly received in said receiving groove so as to mount said first layer on said bottom frame and cover said central window to form said tension surface;

wherein said second layer has four edge sections integrally and overlappedly extended from four outer edges of said first layer, wherein said four edge sections of said second layer are respectively formed by folding said four outer edges of said first layer to a bottom surface thereof overlappedly, so as to define said receiving groove having a U-shaped cross section between said first layer and each said edge section of said second layer;

wherein said bottom frame comprises two pairs of parallel bottom frame legs connected end to end to form a rectangular structure that also supports said bottom wall in a corresponding rectangular shape, and four bottom joints provided at four corners of said bottom frame respectively wherein each of said bottom joints has a tubular sleeve extending vertically;

wherein said bottom wall further comprises at least a retaining element which is a stitching line extended along said four sides of said bottom wall by sewing through said first and second layers, wherein a surrounding tubular chamber is formed between said retaining element and said four sides of said bottom wall to form said receiving groove so that said bottom frame legs of said bottom frame are enclosed and retained inside said surrounding tubular chamber of said receiving groove, moreover, said retaining element substantially stitching said first and second layers together such that an inner surface of said first layer is pulled to contact with an inner surface of said second layer and thus said first and second layers are pushed towards each other so as to substantially increase a surface tension of said first and second layers, therefore, a surface area of said first layer encircled by said retaining element forms said tension surface and a predetermined tension of said tension surface is retained, wherein said bottom wall further has four corner notches provided at four corners of said bottom wall for registering with said four bottom joints respectively.

2. A boundary structure, comprising:

a boundary frame constructed to support a fabric made boundary shelter;

a bottom frame, which is supported at a bottom portion of said boundary frame and defines a central window, wherein four bottom joints provided at four corners of said bottom frame respectively and each of said bottom joints has a tubular sleeve extending vertically; and a bottom wall comprising a first layer having a tension surface and a second layer overlapped with said first layer to define a receiving groove between said first and second layers, wherein said bottom frame has a size and shape arranged to be fittedly received in said receiving groove so as to mount said first layer on said bottom frame and cover said central window to form said tension surface;

wherein said second layer has four edge sections integrally and overlappedly extended from four outer edges of said first layer, wherein said four edge sections of said second layer are respectively formed by folding said four outer edges of said first layer to a bottom surface thereof overlappedly, so as to define said receiving groove having a U-shaped cross section between said first layer and each said edge section of said second layer;

wherein said bottom wall further comprises at least a retaining element which is a stitching line extended along said receiving groove of said bottom wall by sewing through said first and second layers so as to enclose said bottom frame therein;

wherein said boundary frame further comprises a top frame which has a corresponding rectangular shape and comprises four top joints provided at four corners of said top frame respectively, wherein each of said top joints has a tubular socket that opens downward and aligns with said tubular sleeve of said respective bottom joint, and a supporting frame comprises four supporting posts each of which having an inserting end and a locking end wherein each of said supporting posts is arranged to slidably pass through a tubular sleeve of said respective bottom joint until said inserting end of said supporting post is fittedly inserted into said tubular socket of said top joint and said locking end of said supporting post is lock up with said tubular sleeve of said bottom joint, so as to secure said supporting post between said top and bottom joints.

3. A boundary structure, comprising:

a boundary frame constructed to support a fabric made boundary shelter;

a bottom frame which is supported at a bottom portion of said boundary frame and defines a central window, and a bottom wall comprising a first layer having a tension surface and a second layer overlapped with said first layer to define a receiving groove between said first and second layers, wherein said bottom frame has a size and shape arranged to be fittedly received in said receiving groove so as to mount said first layer on said bottom frame and cover said central window to form said tension surface;

wherein said second layer has four edge sections integrally and overlappedly extended from four outer edges of said first layer, wherein said four edge sections of said second layer are respectively formed by folding said four outer edges of said first layer to a bottom surface thereof overlappedly, so as to define said receiving groove having a U-shaped cross section between said first layer and each said edge section of said second layer;

wherein said bottom frame comprises two pairs of parallel bottom frame legs connected end to end to form a rectangular structure that also supports said bottom wall in a corresponding rectangular shape, and four bottom joints provided at four corners of said bottom frame respectively wherein each of said bottom joints has a tubular sleeve extending vertically;

wherein said bottom wall further comprises at least a retaining element which is a stitching line extended along said four sides of said bottom wall by sewing through said first and second layers, wherein a surrounding tubular chamber is formed between said retaining element and said four sides of said bottom wall to form said receiving groove so that said bottom frame legs of said bottom frame are enclosed and retained inside said surrounding tubular chamber of said receiving groove, moreover, said retaining element substantially stitching said first and second layers together such that an inner surface of said first layer is pulled to contact with an inner surface of said second layer and thus said first and second layers are pushed towards each other so as to substantially increase a surface tension of said first and second layers, therefore, a surface area of said first layer encircled by said retaining element forms said tension surface and a predetermined tension of said tension surface is retained;

wherein said boundary frame further comprises a top frame which has a corresponding rectangular shape and comprises four top joints provided at four corners of said top frame respectively wherein each of said top joints has a tubular socket that opens downward and aligns with said tubular sleeve of said respective bottom joint, and a supporting frame comprises four supporting posts each of which having an inserting end and a locking end wherein each of said supporting posts is arranged to slidably pass through said tubular sleeve of said respective bottom joint until said inserting end of said supporting post is fittedly inserted into said tubular socket of said top joint and said locking end of said supporting post is locked with said tubular sleeve of said bottom joint, so as to securely lock up said supporting post between said top and bottom joints.

4. A boundary structure, comprising:

a boundary frame constructed to support a fabric made boundary shelter;

a bottom frame which is supported at a bottom portion of said boundary frame and defines a central window, and a bottom wall comprising a first layer having a tension surface and a second layer overlapped with said first layer to define a receiving groove between said first and second layers, wherein said bottom frame has a size and shape arranged to be fittedly received in said receiving groove so as to mount said first layer on said bottom frame and cover said central window to form said tension surface;

wherein said second layer has four edge sections integrally and overlappedly extended from four outer edges of said first layer, wherein said four edge sections of said second layer are respectively formed by folding said four outer edges of said first layer to a bottom surface thereof overlappedly, so as to define said receiving groove having a U-shaped cross section between said first layer and each said edge section of said second layer;

wherein said bottom frame comprises two pairs of parallel bottom frame legs connected end to end to form a rectangular structure that also supports said bottom wall in a corresponding rectangular shape, and four bottom joints provided at four corners of said bottom frame respectively wherein each of said bottom joints has a tubular sleeve extending vertically;

wherein one of said pair of bottom frame legs is a pair of foldable legs wherein a folding joint is constructed at a center portion of said pair of foldable legs such that said bottom frame has a foldable structure that enables said bottom frame to be folded in half;

wherein said bottom wall further comprises at least a retaining element which is a stitching line extended along said four sides of said bottom wall by sewing through said first and second layers, wherein a surrounding tubular chamber is formed between said retaining element and said four sides of said bottom wall to form said receiving groove so that said bottom frame legs of said bottom frame are enclosed and retained inside said surrounding tubular chamber of said receiving groove, moreover, said retaining element substantially stitching said first and second layers together such that an inner surface of said first layer is pulled to contact with an inner surface of said second layer and thus said first and second layers are pushed towards each other so as to substantially increase a surface tension of said first and second layers, therefore, a surface area of said first layer encircled by said retaining element forms said tension surface and a predetermined tension of said tension surface is retained;

wherein said bottom wall further has four corner notches provided at four corners of said bottom wall for registering with said four bottom joints respectively and two side notches provided at two opposed sides of said bottom wall for registering with said two folding joints of said bottom frame respectively.

5. The boundary structure, as recited in claim 4, wherein said boundary frame further comprises a top frame comprising a first pair of parallel top frame arms and a second pair of parallel top frame arms, and four top joints arranged to connect said four top frame arms together end to end to form a corresponding rectangular structure, and a supporting frame comprising four supporting posts arranged to firmly connected between said four top joints and said four bottom joints respectively.

6. The boundary structure, as recited in claim 5, wherein two of said top joints form a first set of said top joints having two transverse tubular sleeves respectively and another two of said top joints form a second set of said top joints having two tubular sockets that open transversely and align with said tubular sleeves of said first set of said top joints respectively, and wherein each of the first pair of the top frame arms has an inserting end and a locking end wherein each of said first pair of said top frame arms is arranged to slidably pass through said tubular sleeve until said inserting end of said top frame arms is fittedly inserted into said tubular socket and said locking end of said top frame arms is locked with said tubular sleeve of said respective top joint, so as to securely lock up said top frame arms between said two top joints.

7. A boundary structure, comprising:

a boundary frame constructed to support a fabric made boundary shelter;

a bottom frame which is supported at a bottom portion of said boundary frame and defines a central window, and a bottom wall comprising a first layer having a tension surface and a second layer overlapped with said first layer to define a receiving groove between said first and second layers, wherein said bottom frame has a size and shape arranged to be fittedly received in said receiving groove so as to mount said first layer on said bottom frame and cover said central window to form said tension surface;

wherein said second layer has four edge sections integrally and overlappedly extended from four outer edges of said first layer, wherein said four edge sections of said second layer are respectively formed by folding said four outer edges of said first layer to a bottom surface thereof overlappedly, so as to define said receiving groove having a U-shaped cross section between said first layer and each said edge section of said second layer;

wherein said bottom frame comprises two U-shaped bottom frame legs pivotally connected end to end to form a rectangular structure that also supports said bottom wall in a corresponding rectangular shape.

8. The boundary structure, as recited in claim 7, wherein said bottom wall further comprises at least a retaining element which is a stitching line extended along four sides of said bottom wall by sewing through said first and second layers, wherein a surrounding tubular chamber is formed between said retaining element and said four sides of said bottom wall to form said receiving groove so that said bottom frame legs of said bottom frame are enclosed and retained inside said surrounding tubular chamber of said receiving groove, moreover, said retaining element substantially stitching said first and second layers together such that an inner surface of said first layer is pulled to contact with an inner surface of said second layer and thus said first and second layers are pushed towards each other so as to substantially increase a surface tension of said first and second layers, therefore, a surface area of said first layer encircled by said retaining element forms said tension surface and a predetermined tension of said tension surface is retained.

9. The boundary structure, as recited in claim 8, wherein said boundary frame further comprises a top frame, which has a corresponding rectangular shape and comprises two top joints and two U-shaped top frame arms each having two ends pivotally connected to said two top joints respectively and a supporting frame comprising two U-shaped supporting posts each of which having two ends pivotally connected to said two top joints respectively and inclinedly and downwardly extended to pivotally connect to outer sides of said two bottom frame legs respectively.

10. The boundary structure, as recited in claim 9, wherein said bottom wall further has four corner notches provided at four corners of said bottom wall for registering with said supporting posts of said supporting frame respectively.

11. The boundary structure, as recited in claim 10, wherein said supporting frame further comprises two pairs of locking joints for locking said top frame arms in a horizontal position to form a rectangular structure, wherein each of said locking joints comprises a lock body and two pivot arms having two inner ends pivotally connected to said lock body respectively and two outer ends pivotally connected to said top frame arm and said supporting post respectively, in such a manner that said two pivot arms are arranged to pivotally fold in an opposite direction to support said respective top frame arm in a horizontal position and pivotally fold towards each other to pivotally drop down said top frame arm towards to said supporting post.

12. A boundary structure, comprising:

a boundary frame constructed to support a fabric made boundary shelter;

a bottom frame which is supported at a bottom portion of said boundary frame and defines a central window, wherein four bottom joints provided at four corners of said bottom frame respectively and each of said bottom joints has a tubular sleeve extending vertically, and a bottom wall comprising a first layer having a tension surface and a second layer overlapped with said first layer to define a receiving groove between said first and second layers, wherein said bottom frame has a size and shape arranged to be fittedly received in said receiving groove so as to mount said first layer on said bottom frame and cover said central window to form said tension surface;

wherein said boundary frame further comprises a top frame which has a corresponding rectangular shape and comprises four top joints provided at four corners of said top frame respectively wherein each of said top joints has a tubular socket that opens downward and aligns with said tubular sleeve of said respective bottom joint, and a supporting frame comprising four supporting posts each of which having an inserting end and a locking end wherein each of said supporting posts is arranged to slidably pass through said tubular sleeve until said inserting end of said supporting post is fittedly inserted into said tubular socket of said top joint and said locking end of said supporting post is locked with said tubular sleeve of said bottom joint so as to secure said supporting post between said top and bottom joints.

13. A lightweight bottom wall structure for playyard, pen, cot, or the like, which comprises a boundary frame constructed to support a fabric made boundary shelter, comprising:

a bottom frame for supporting a bottom portion of said boundary frame and defining a central window, wherein said bottom frame comprises two pairs of parallel bottom frame legs connected end to end to form a rectangular structure and four bottom joints provided at four corners of said bottom frame respectively, wherein one of said pair of bottom frame legs is a pair of foldable legs and a folding joint is constructed at a center portion of said pair of foldable legs such that said bottom frame has a foldable structure that enables said bottom frame to be folded in half, and a bottom wall comprising a first layer having a tension surface and a second layer overlapped with said first layer to define a receiving groove between said first and second layers, wherein said bottom frame has a size and shape arranged to be fittedly received in said receiving groove so as to mount said first layer on said bottom frame and cover said central window to form said tension surface, wherein said bottom wall further has four corner notches provided at four corners of said bottom wall for registering with said four bottom joints respectively and two side notches provided at two opposed sides of said bottom wall for registering with said two folding joints of said bottom frame respectively.

14. A boundary structure, comprising:

a boundary frame constructed to support a fabric made boundary shelter;

a bottom frame for supporting a bottom portion of said boundary frame and defining a central window, wherein said bottom frame comprises two pairs of parallel bottom frame legs connected end to end to form a rectangular structure and four bottom joints provided at four corners of said bottom frame respectively, wherein one of said pair of bottom frame legs is a pair of foldable legs and a folding joint is constructed at a center portion of said pair of foldable legs such that said bottom frame has a foldable structure that enables said bottom frame to be folded in half, and a bottom wall comprising a first layer having a tension surface and a second layer overlapped with said first layer to define a receiving groove between said first and second layers, wherein said bottom frame has a size and shape arranged to be fittedly received in said receiving groove so as to mount said first layer on said bottom frame and cover said central, window to form said tension surface, wherein said bottom wall further has four corner notches provided at four corners of said bottom wall for registering with said four bottom joints respectively and two side notches provided at two opposed sides of said bottom wall for registering with said two folding joints of said bottom frame respectively;

wherein said boundary frame further comprises a top frame comprising a first pair of parallel top frame arms and a second pair of parallel top frame arms, and four top joints arranged to connect said four top frame arms together end to end to form a corresponding rectangular structure, and a supporting frame comprising four supporting posts arranged to be firmly connected between said four top joints and said four bottom joints respectively.

15. The boundary structure, as recited in claim 14, wherein two of said top joints form a first set of said top joints having two transverse tubular sleeves respectively and another two of said top joints form a second set of said top joints having two tubular sockets that open transversely and align with said tubular sleeves of said first set of said top joints respectively, and wherein each of the first pair of the top frame arms has an inserting end and a locking end wherein each of said first pair of said top frame arms is arranged to slidably pass through said tubular sleeve until said inserting end of said top frame arms is fittedly inserted into said tubular socket and said locking end of said top frame arms is locked with said tubular sleeve of said respective top joint, so as to securely lock up said top frame arms between said two top joints.

16. A lightweight bottom wall structure for playyard, pen, cot, or the like, which comprises a boundary frame constructed to support a fabric made boundary shelter, comprising:

a bottom frame for supporting a bottom portion of said boundary frame and defining a central window, and a bottom wall comprising a first layer having a tension surface and a second layer overlapped with said first layer to define a receiving groove between said first and second layers, wherein said bottom frame has a size and shape arranged to be fittedly received in said receiving groove so as to mount said first layer on said bottom frame and cover said central window to form said tension surface;

wherein said bottom frame comprises two U-shaped bottom frame legs pivotally connected end to end to form a rectangular structure that also supports said bottom wall in a corresponding rectangular shape.

17. The lightweight bottom wall structure, as recited in claim 16, wherein said bottom wall further comprises at least a retaining element which is a stitching line extended along four sides of said bottom wall by sewing through said first and second layers, wherein a surrounding tubular chamber is formed between said retaining element and: said four sides of said bottom wall to form said receiving groove so that said bottom frame legs of said bottom frame is enclosed and retained inside said surrounding tubular chamber of said receiving groove, moreover, said retaining element substantially stitching said first and second layers together such that an inner surface of said first layer are pulled to contact with an inner surface of said second layer and thus said first and second layers are pushed towards each other so as to substantially increase a surface tension of said first and second layers, therefore, a surface area of said first layer encircled by said retaining element forms said tension surface and a predetermined tension of said tension surface is retained.

18. A boundary structure, comprising:

a boundary frame constructed to support a fabric made boundary shelter; and a bottom frame which is supported at a bottom portion of said boundary frame and defining a central window, and a bottom wall comprising a first layer having a tension surface and a second layer overlapped with said first layer to define a receiving groove between said first and second layers, wherein said bottom frame has a size and shape arranged to be fittedly received in said receiving groove so as to mount said first layer on said bottom frame and cover said central window to form said tension surface;

wherein said bottom frame comprises two U-shaped bottom frame legs pivotally connected end to end to form a rectangular structure that also supports said bottom wall in a corresponding rectangular shape;

wherein said bottom wall further comprises at least a retaining element which is a stitching line extended along four sides of said bottom wall by sewing through said first and second layers, wherein a surrounding tubular chamber is formed between said retaining element and said four sides of said bottom wall to form said receiving groove so that said bottom frame legs of said bottom frame is enclosed and retained inside said surrounding tubular chamber of said receiving groove, moreover, said retaining element substantially stitching said first and second layers together such that an inner surface of said first layer are pulled to contact with an inner surface of said second layer and thus said first and second layers are pushed towards each other so as to substantially increase a surface tension of said first and second layers, therefore, a surface area of said first layer encircled by said retaining element forms said tension surface and a predetermined tension of said tension surface is retained;

wherein said boundary frame further comprises a top frame which has corresponding rectangular shape and comprises two top joints and two U-shaped top frame arms each having two ends pivotally connected to said two top joints respectively and a supporting frame comprising two U-shaped supporting posts each of which having two ends pivotally connected to said two top joints respectively and inclinedly and downwardly extended to pivotally connect to outer sides of said two bottom frame legs respectively.

19. The boundary structure, as recited in claim 18, wherein said bottom wall further has four corner notches provided at four corners of said bottom wall for registering with said supporting posts of said supporting frame respectively.

20. The boundary structure, as recited in claim 19, wherein said supporting frame further comprises two pairs of locking joints for locking said top frame arms in a horizontal position to form a rectangular structure, wherein each of said locking joints comprises a lock body and two pivot arms having two inner ends pivotally connected to said lock body respectively and two outer ends pivotally connected to said top frame arm and said supporting post respectively, in such a manner that said two pivot arms are arranged to pivotally fold in an opposite direction to support said respective top frame arm in a horizontal position and pivotally fold towards each other to pivotally drop down said top frame arm towards to said supporting post.

* * * * *